United States Patent [19]

van Donk

[11] Patent Number: 4,643,369

[45] Date of Patent: Feb. 17, 1987

[54] STORAGE DEVICE FOR FILAMENTARY MATERIAL

[75] Inventor: Cornelis van Donk, Mortel, Netherlands

[73] Assignee: Sulzer Brothers Limited, Winterthur, Switzerland

[21] Appl. No.: 820,265

[22] Filed: Jan. 17, 1986

[30] Foreign Application Priority Data

Jan. 18, 1985 [EP] European Pat. Off. ..... 85 100493.7

[51] Int. Cl.[4] ..... B65H 51/20

[52] U.S. Cl. ..... 242/47.01; 242/47.12; 139/452

[58] Field of Search ..... 242/47.01, 47.12, 47.13; 139/452; 66/132 R

[56] References Cited

U.S. PATENT DOCUMENTS

| | | | |
|---|---|---|---|
| 4,238,080 | 12/1980 | Van Mullekom | 242/47.12 |
| 4,410,146 | 10/1983 | Van Hest | 242/47.01 |
| 4,441,531 | 4/1984 | Umezawa et al. | 242/47.01 X |
| 4,444,226 | 4/1984 | Ichikawa et al. | 242/47.01 X |
| 4,462,434 | 7/1984 | Takegawa | 242/47.01 X |
| 4,463,910 | 8/1984 | Van Mullekom | 242/47.12 |
| 4,476,904 | 10/1984 | Ito et al. | 242/47.01 X |
| 4,498,639 | 2/1985 | Deborde et al. | 242/47.01 |
| 4,557,299 | 12/1985 | Henzl et al. | 242/47.01 X |

FOREIGN PATENT DOCUMENTS

| | | | |
|---|---|---|---|
| 0142591 | 5/1985 | European Pat. Off. | 139/452 |
| 9242 | 1/1984 | Japan | 139/452 |
| 53742 | 3/1984 | Japan | 139/452 |

*Primary Examiner*—Stanley N. Gilreath

*Attorney, Agent, or Firm*—Kenyon & Kenyon

[57] ABSTRACT

The reel is comprised of a support member containing a rotational axis, a substantially cylindrical winding drum having a central axis and a number of peripheral elements which are adjustable radially of the winding drum to different winding diameters. The winding drum and elements form a polygonal to substantially circular guide path for the filamentous material adapted to be drawn off over end from the reel. The winding drum is secured to the support member via screws so as to be adjustable transversely of the rotational axis and is adapted to be secured in a central operating position and in a number of eccentric operating positions relative to the rotational axis. In each of the eccentric operating positions, the peripheral elements are adjustable to a circle circumscribed centrally to the rotational axis.

18 Claims, 7 Drawing Figures

STORAGE DEVICE FOR FILAMENTARY MATERIAL

This invention relates to a storage device for filamentary material. More particularly, this invention relates to a weft storage device for a weaving machine.

As is known, various types of storing devices have been provided for storing filamentary material such as weft yarn, tape, wire, or the like. Usually, such storage devices incorporate a supply reel from which the filamentary material may be drawn off, for example the drawing off of a weft yarn to a weaving machine. In some cases, the supply reel has been constructed of a support member which is disposed about a rotational axis and a substantially cylindrical winding drum which is disposed on the support member about a central axis. In some cases, a plurality of peripheral elements have been mounted on the winding drum in adjustable radial manner so as to be positioned to guide the filamentary material as a single-layer winding on the reel periphery for subsequent drawing off over and axially from the reel.

Storage devices of the above type are described in European Published Patent Application No. 0142591. In this embodiment, the winding drum is mounted as to be fixed with respect to the rotational axis eccentrically in an edge zone of a support disk which is rotatable about the rotational axis. Alternatively, the winding drum can be mounted so as to be secured against rotation. In these constructions, different winding diameters can be set according to the radial position of the peripheral elements at any time. In this regard, the peripheral elements cooperate with a peripheral part of the winding drum in order to define a polygonal to substantially circular guide path for the filamentary material for storage purposes. In these conditions, only the guide path which corresponds to the maximum winding diameter extends substantially concentrically to the rotational axis while the other guide paths corresponding to the smaller winding diameters each extend eccentrically to the rotational axis. As a result of the increasing eccentricity of the windings corresponding to the decreasing reel diameter, there may be a discontinuous stress, particularly with small reel diameters. Hence, there may be tension variations in the part of the filamentary material extending from a supply spool to the reel of the storage device.

Accordingly, it is an object of the invention to ensure a continuous drawing of filamentary material by a winding reel from a supply spool without adversely affecting the material.

It is another object of the invention to provide a storage device for filamentary material which can be adjusted to different winding diameters.

It is another object of the invention to provide a reel of relatively simple construction which can be readily adjusted to different winding diameters while maintaining the windings concentric to a common axis of rotation.

Briefly, the invention provides a reel for a storage device for filamentary material which is comprised of a support member disposed about a rotational axis, a cylindrical winding drum having a central axis, a plurality of elements mounted peripherally on the drum and being adjustable radially of the drum central axis in order to guide a winding of filamentary material thereon for delivery axially therefrom and means securing the drum to the support member in a transversely adjustable manner relative to the rotational axis.

The means which secures the winding drum to the support member permits the adjustment of the winding drum about a pivot axis which is offset from both the rotational axis of the support member and the central axis of the winding drum. In this respect, the pivot axis is equidistant from both the rotational axis and the central axis.

In one embodiment, a means for securing the drum to the support member includes at least a pair of retaining members, such as screws, which engage an end face of the winding drum in offset relation to each around the central axis of the drum while being secured against the support member. In this embodiment, the support member has at least two guide slots for guiding the respective retaining member therein. For example, the slots may be of arcuate shape and disposed concentrically of the pivot axis.

With this construction, the peripheral elements can be adjusted into a radial position with respect to the winding drum in every eccentric position of the winding drum with respect to the rotational axis defined by the support member. With the elements disposed radially of the central axis of the winding drum and in planes perpendicular to the central axis of the winding drum and with the peripheral part of the winding drum which is situated in the same plane and furthest away from the rotational axis, a circumscribed circle is defined which is concentric to the rotational axis of the support member. Thus, the windings of the filamentary material about the drum and peripheral elements are disposed concentrically and axially of the rotational axis of the support member.

The diameter of the windings on the reel can be freely adjustable between limits defined by the corresponding dimensions of the support member and the winding drum.

The construction of the reel provides a substantially constant and very low stressing of the filamentary material for all reel diameters and is therefor particularly suitable for processing sensitive filamentary material.

The connection of the winding drum to the support member so as to be pivotable about a pivot axis offset from a rotational axis provides a very easy and reliable means for an accurate adjustment of the reel diameter at any time while maintaining an accurately defined connection between the relatively adjustable parts.

Of note, the winding drum may be adjusted without the use of peripheral elements concentrically to the rotational axis of the reel so that even at the smallest reel diameter defined by the winding drum diameter, the filamentary material may be wound for storage at a substantially constant tension.

The use of retaining members in the form of screws provides a construction of very compact and operationally reliable construction. Further, the use of guide slots to guide the retaining members allows an infinitely variable adjustment of the reel diameter accurately over the entire range of adjustment in a simple manner.

The reel may also be provided with an aperture in the periphery of the winding drum while a plurality of guide elements are permitted to extend through the aperture in order to drive individual windings of the filamentary material along the peripherally mounted elements. In this case, a shaft is mounted on the winding drum for driving the guide elements and is disposed in offset relation from the rotational axis. In addition, a drive shaft on the rotational axis is disposed in driving engagement with the shaft in order to drive the respective guide elements. In this case also, the shaft on which the guide elements are mounted is adjustable about the drive shaft. By means of this arrangement, the guide element drive which is derived from the machine drive can be gauranteed in any position of the winding drum. Thus, the individual guide elements can be used to separate each winding package stored on the reel and ready for a next operation, such as a weft picking operation from a winding package to be formed for a subsequent picking operation.

In order to provide a compact construction with relatively small axial dimensions, the guide elements may be mounted on a rotating member which is rotatable about a shaft which extends transversely of the rotational axis while a recess is provided in the end face of the support member to receive the guide elements in spaced lateral relationship. Thus, during rotation of the guide elements, each may pass into and through the recess of the support member while during adjustment of the winding drum, the guide elements may be moved laterally within the recess of the support member.

The reel may be constructed so that the support member is stationary or is rotatable. In the first case, filamentary material may be supplied via a rotating member so as to feed the filamentary material over the support member and onto the winding drum. In the latter case, the filamentary material may be supplied directly from a supply spool to the winding drum.

These and other objects and advantages of the invention will become more apparent from the following detailed description taken in conjunction with the accompanying drawings wherein.

Figure 1:
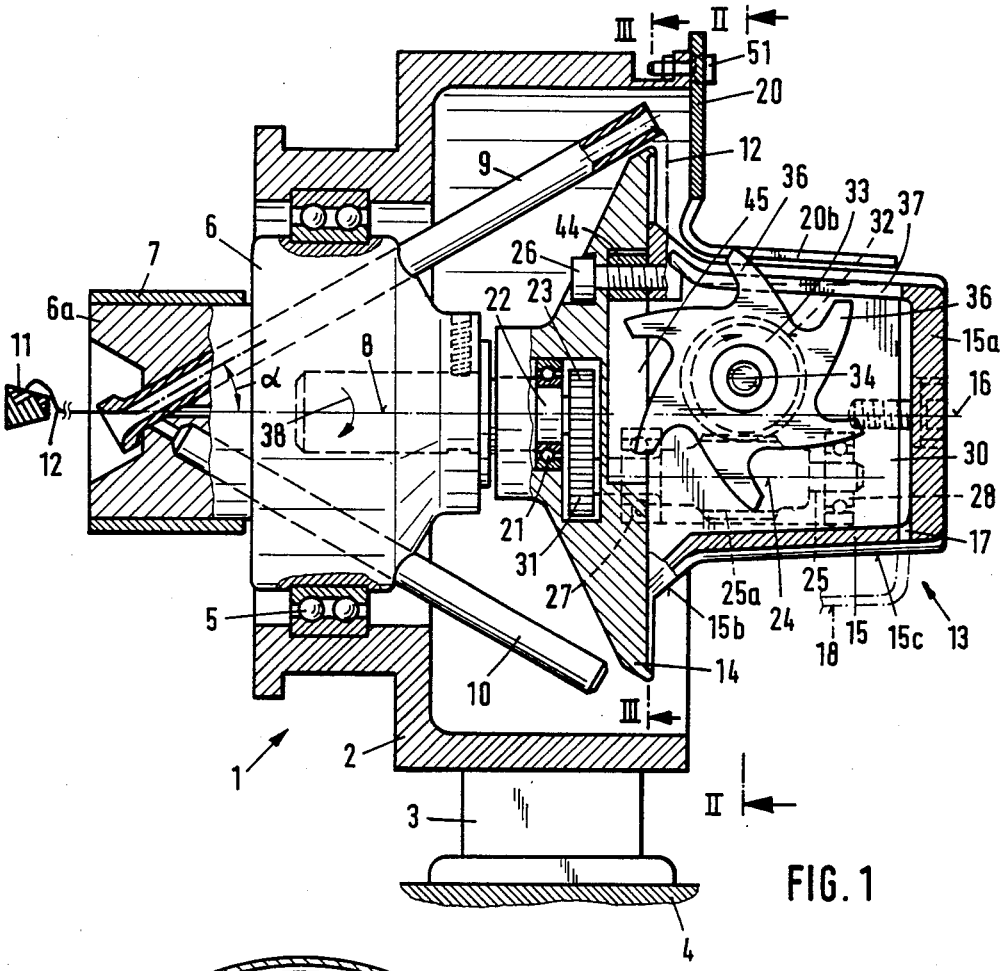
FIG. 1 illustrates a cross-sectional view of a storage device constructed in accordance with the invention.

Referring to FIG. 1, the storage device 1 includes a fixed housing 2 which is secured via a base part 3 to a support 4, for example of a weaving machine or bobbin frame. In addition, a drive member 6 is mounted for rotation via a ball bearing 5 in the housing 2 and is in driving connection to a weaving machine drive control shaft (not shown) via a pinion 6*a* and, for example, a belt drive 7.

As indicated, the drive member 6 comprises a guide tube 9 inclined to a rotational axis 8 of the drive member 6 at an angle $\alpha$ of e.g. 40" and a correspondingly inclined compensating rod 10 disposed diametrically with respect to the guide tube 9 and serving for mass balancing. The guide tube 9, which can be mounted rotatably in the drive member 6, and which can, if required, be rotated about its axis via a drive means (not shown), is used to supply a weft yarn 12 show in broken lines coming from a supply reel 11, to the periphery of a fixed reel 13.

Figure 2:
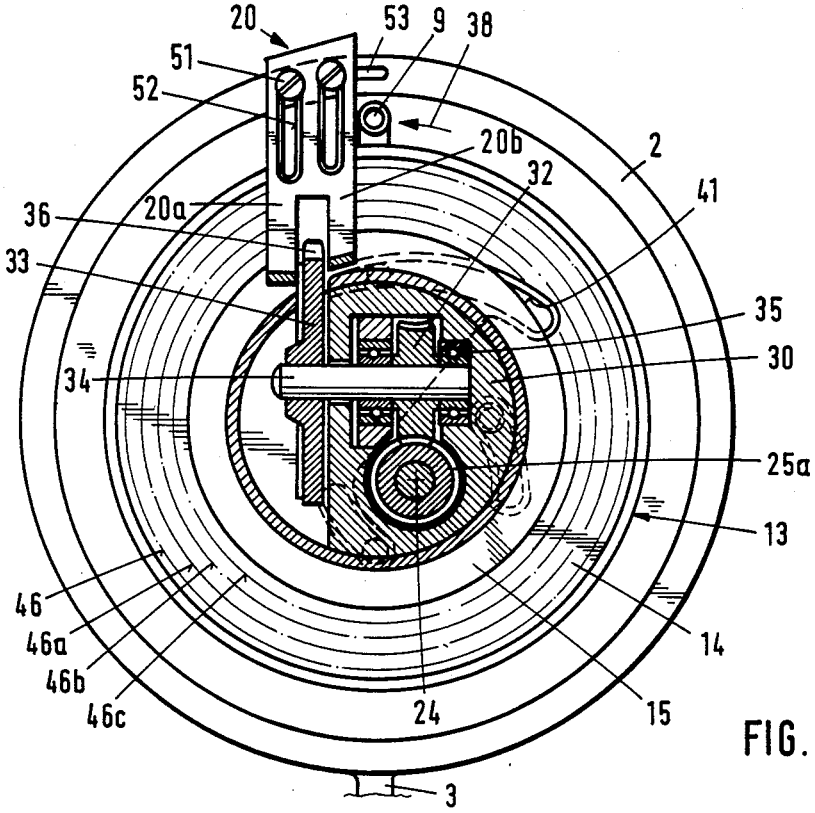
FIG. 2 illustrates a view taken on line II—II of FIG. 1.

The reel 13 includes a support member in the form of a main disc 14 disposed on the rotational axis 8 and a substantially cylindrical winding drum 15 having a central axis 16. As shown in FIG. 1, guides 17 may be provided at the head end 15*a* of the winding drum for a plurality of, e.g. seven, bow-shaped peripheral elements 18 which are radially adjustable with respect to the central axis 16 and which each have a support part 18*a* (FIG. 6) for the weft yarn 12 for winding. Each support part 18*a* is adjustable substantially parallel to the adjacent generatrix of the winding drum 15. Corresponding peripheral elements, whose construction and fixing on the winding drum 15 and on the main disc 14 are not part of this invention, are known, for example from German OS No. 29 20 629. In the operating position of the winding drum 15 coaxial with the rotational axis 8 as shown in FIGS. 1 and 2, the peripheral elements 18, of which one is shown in chain-dotted lines in FIG. 1, are absent.

The main disc 14 is mounted by ball bearings 21, only one of which is shown in FIG. 1, on a drive shaft 22 fixed to the drive member 6. In addition, a gearwheel 23 is keyed on the shaft 22 within a cavity of the disc 14.

The disc 14 and the winding drum 15 connected thereto are secured against rotation as will be described hereinafter by means of a fork-shaped guide bow member 20 which is adjustably secured to the housing 2 via screws 51.

Figure 4:
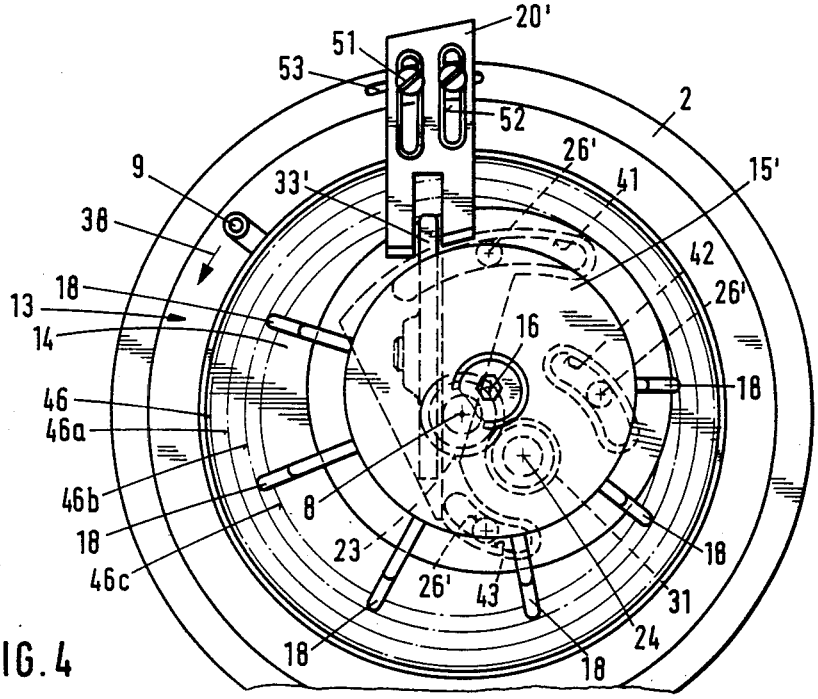
FIG. 4 illustrates a view similar to FIG. 2 of the winding drum in a different operating position in accordance with the invention.
Figure 5:
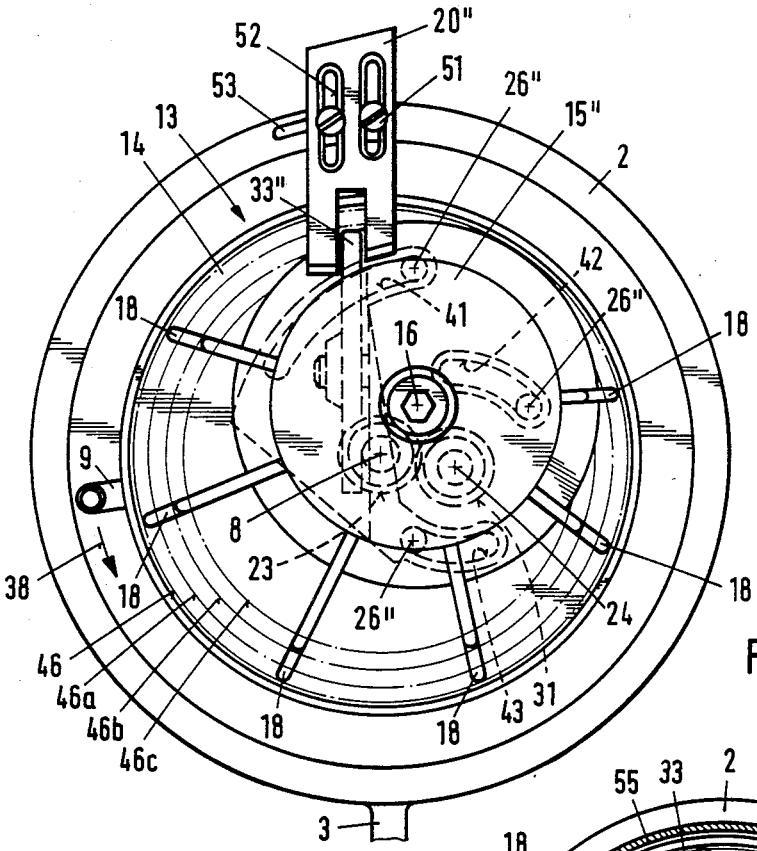
FIG. 5 illustrates a view similar to FIG. 2 of the winding drum in a further operating position in accordance with the invention.

A reel 13 also has means securing the drum 15 to the disc 14 in a transversely adjustable manner relative to the rotational axis 8. For example, this means includes a shaft 25 which defines a pivot axis 24 and a plurality of retaining members 26 in the form of screws. The pivot shaft axis 24 is disposed in parallel to the rotational axis 8 and to the central axis 16 and is offset eccentrically from those axes 8, 16 by the same amount, i.e. being equidistant from each as indicated in FIGS. 4 and 5. The shaft 25 is also provided with a drive worm 25*a* (FIGS. 1 and 2) and is mounted in the main disc 14 by way of a ball bearing 27 and in a gear housing 30 disposed in the winding drum 15 by way of a ball bearing 28. A gearwheel 31 is secured to the end of the shaft 25 facing the main disc 14 and meshes with a gearwheel 23 of the drive shaft 22. The drive worm 25*a* engages a worm wheel 32 secured to a starwheel 33 on a shaft 34 disposed transversely of the axis of the winding drum 15, i.e. transversely of the rotational axis 8 and central axis 16. The shaft 34 is mounted in the housing 30 by way of ball bearings 35 (FIG. 2).

The starwheel 33 defines a plurality of guide elements 36 which are introducible between two arms 20*a*, 20*b* of the guide bow member 20 through an aperture 37 formed at the periphery of the drum 15 and extending substantially parallel to the spindle axis 16.

During operation, the drive member 6 rotates with the gearwheel 23 and the guide tube 9 in the direction indicated by the arrow 38 in FIG. 2 around the rotational axis 8, the entry end of the guide tube 9 always remaining in the zone of the rotational axis 8. The weft yarn 12 coming from the outlet end of the guide tube 9 is placed in turns (windings) on a via conical peripheral part 15*b* of the winding drum 15. These turns are then pushed to the right (FIG. 1) by the guide elements 36 of the starwheel 33 driven via the shaft 25, over the substantially cylindrical or, as shown, slightly conical peripheral part 15*c* of the winding drum, and are drawn off intermittently in each case over the head end 15*a* of the winding drum 15 during a weft picking operation.

Figure 3:
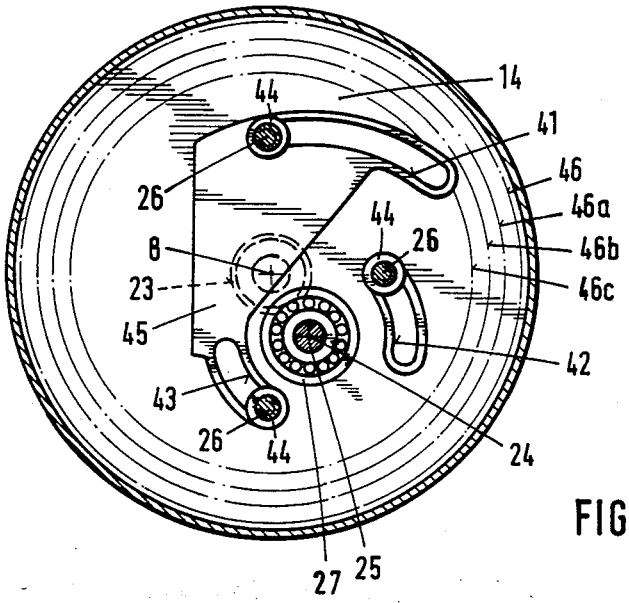
FIG. 3 illustrates a view taken on line III—III of FIG. 1.

Referring to FIGS. 1 and 3, the three screws 26, each disposed in a guide sleeve 44, engage the end face of the winding drum 15 in offset relation to each other around the central axis 16 while passing through arcuate slots 41, 42, 43 disposed concentrically with the pivot axis 24 in the support disc 14. In addition, a portion of the peripheral part of the starwheel 33 projects into the zone of the main disc 14, the shape of the recess 45 being adapted to the rotation zone of the starwheel 33, which is pivotable about the axis 24 with the winding drum 15.

Annular grooves concentric with the rotational axis may be formed at the end face of the disc 14 or, as shown in broken lines in FIG. 2, 3, 4 and 5, corresponding concentric marking circles 46 46*a*, 46*b*, 46*c* may be provided, which serve to guide or facilitate the adjustment of the peripheral elements 18 with respect to the main disc 14.

With the screws 26 and the bow member 20 released, the winding drum 15 is adjustable by pivoting about the axis 24 of the shaft 25 with respect to the fixed main disc 14. With the screws 26 fastened, the pivot shaft 25 can be walked about the drive shaft 22 via the gears 31, 23 respectively, as to replace the star wheel 33 into a vertical position, as viewed in FIGS. 2, 4 and 5, in which position it can be secured by fastening the bow member 20. The drum 15 can thus be moved between the central operating position with respect to the rotational axis 8 as shown in FIG. 2 and an eccentric operating position 15″ with respect to the rotational axis 8 as shown in FIG. 5. In this latter position, the edge of the winding drum 15 abutting the main disc 14 touches the maximum marking circle 46 extending along the edge of the main disc 14. Correspondingly, the screws 26 guided in the slots 41, 42, 43 are each adjustable between the position shown in FIG. 3 and a position 26″ shown in FIG. 5, so that fixing of the winding drum 15 in any desired eccentric operating position situated within the pivoting zone is guaranteed.

FIG. 4 shows a middle operating position 15′ in which the edge of the winding drum 15 is adjusted to the smaller marking circle 46*b* and the screws 26 each occuoy a corresponding position 26′.

As shown in FIGS. 2, 4 and 5, the screws 51 which secure the guide member 20 in place are disoosed in slots 52 which extend transversely of the periphery of the housing 2. The screws 51 are also guided on the housing 2 so as to be peripherally adjustable and lockable in an arcuate guide slot 53 concentric with the rotational axis 8. The guide member 20 can thus be adjusted in a corresponding operating position 20′ or 20″ in every operating position 15′ or 15″ of the winding drum 15, so that the starwheel 33 is laterally guided in the respective operating positions 33′ and 33″ and the winding drum 15 is secured against rotation.

In the operating position shown in FIGS. 1 and 2, the reel 13 has the smallest diameter defined by the diameter of the winding drum 15 adjusted concentrically to the rotational axis 8. By pivoting of the winding drum 15 about the axis 24 as the axis orbits about the rotational axis 8 and corresponding radial adjustments of the support parts 18*a* of the peripheral elements 18 to a major circle which is concentric with the rotational axis 8 and which touches the peripheral part of the winding drum 15 farthest away from the rotational axis 8, it is possible to set larger winding diameters corresponding to the respective major circle. The yarn turns then extend substantially concentrically of the rotational axis 8 in every position to which the winding drum 15 is pivoted. Correspondingly, the ends of the peripheral elements 18 in the operating position shown in FIG. 4 are set to the marking circle 46*b*, and in the operating position shown in FIG. 5 they are set to the maximum marking circle 46. In this way, the winding diameter of the reel 13 and hence the yarn length to be stored at any time can be adjusted very accurately to different operating requirements governed, for example, by the nature of the yarn material to be processed and, in the case of weaving machines, the width of the fabric for manufacture.

Figure 6:
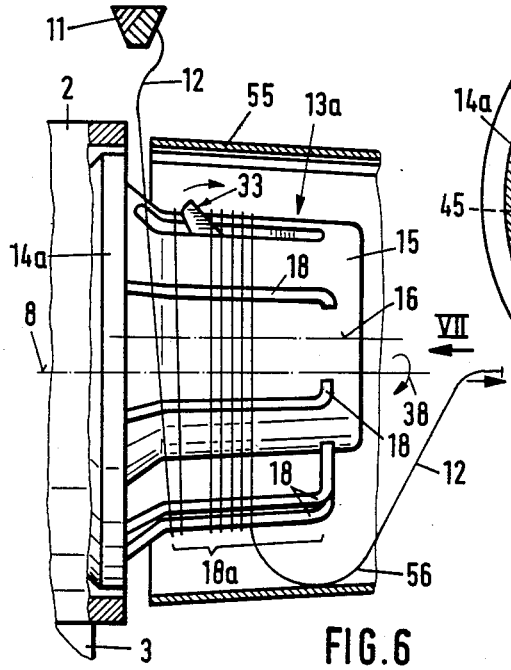
FIG. 6 illustrates a modified storage device having a rotatable support member in accordance with the invention.

As shown in FIG. 6, the winding drum 15 can also be so secured on a rotatable main disc 14*a* coupled to the machine drive as to be adjustable transversely of the rotational axis 8. The main disc 14*a*, the winding drum 15 and the peripheral elements 18 thus form a reel 13*a* which is rotatable about the rotational axis 8 and to which the weft yarn 12 is fed tangentially. The shaft 22 (not shown) forming the rotational axis can be secured against rotation correspondingly. The reel 13*a* can be surrounded by a balloon breaker 55 which is disposed concentrically of the rotational axis 8 and which limits a yarn balloon 56 forming when the weft yarn 12 is drawn from the rotating yarn turn.

Figure 7:
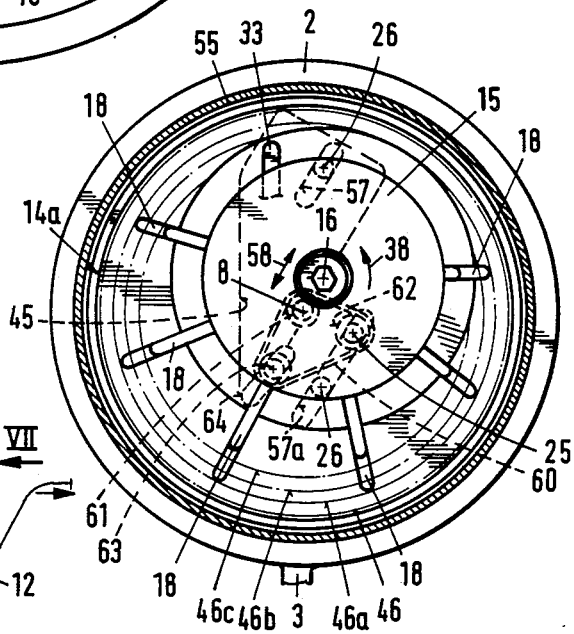
FIG. 7 illustrates a view of the storage device of Fig. 6 taken in the direction of the arrow VII of FIG. 6.

As in the embodiment shown in FIGS. 1 to 5, the winding drum 15 can be pivotally articulated on the main disc 14. As shown in FIG. 7, the winding drum 15 can be rectilinearly adjustable on the main disc 14*a* in the direction indicated by arrows 58 between the central operating position with respect to the rotational axis 8 and the outermost eccentric operating position limited by the edge of the main disc 14*a*. In this case, the screws 26 are guided on the main disc 14*a* in parallel slots 57, 57*a*. In the operating position shown in FIG. 7, the winding drum 15 and the deflecting elements 18 are adjusted to the marking circle 46*a*. The starwheel 33 or some other corresponding means can be driven by a toothed belt 60 which engages around a belt pulley 62 disposed on shaft 25 of worm 25*a*, and a tensioning pulley 63 disposed on the winding drum 15 and tensionable against the toothed belt 60. The spindle of the pulley 63 is movable in a slot 64 in the main disc 14*a*, while the end of the shaft 25 supporting the belt pulley 26 can be movable in a continuation of the slot 57*a*. Embodiments without a starwheel 33 or similar devices are possible, the corresoonding drive means being eliminated.

Instead of guide slots 41, 42, 43; 57, 57*a*, it is possible to provide individual and correspondingly relatively offset bores to receive the screws 26 or corresponding fixing means allowing stepwise adjustment of the reel diameter.

The storage device according to the invention can be used not only in weaving machine but also other machines for processing filamentous material, e.g. knitting machines, embroidery machines and the like.

What is claimed is:

1. A reel for a storage device for filamentary material, said reel comprising a support member disposed about a rotational axis;

a cylindrical winding drum having a central axis;

a plurality of elements mounted peripherally on said drum and being adjustable radially of said drum central axis to guide a winding of filamentary material thereon for delivery axially therefrom; and means securing said drum to said support member in a tranversely adjustable manner relative to said rotational axis.

2. A reel as set forth in claim 1 wherein said means secures said drum to said support member for adjustment about a pivot axis offset from said rotational axis and from said cental axis.

3. A reel as set forth in claim 2 wherein said pivot axis is equidistant from said rotational axis and said central axis.

4. A reel as set forth in claim 1 wherein said means includes at least a pair of retaining members engaging an end face of said drum in offset relation to each other around said central axis, each said retaining member being secured against said support member.

5. A reel as set forth in claim 4 wherein said support member has at least two guide slots for respectively guiding a retaining member therein.

6. A reel as set forth in claim 5 wherein each slot is arcuate and concentric of said pivot axis.

7. A reel as set forht in claim 1 further comprising an aperture in a periphery of said winding drum, a plurality of guide elements extending through said aperture to drive individual windings of filamentary material along said peripherally mounted elements, a first shaft mounted in said winding drum for driving said guide elements and being offset from said rotational axis, and a drive shaft on said rotational axis in driving engagement with said first shaft.

8. A reel as set forth in claim 7 wherein said first shaft is adjustable about said drive shaft.

9. A reel as set forth in claim 7 which further comprises a rotating member having said guide elements mounted thereon, a second shaft secured to said rotating member transversely of said rotational axis, a recess in said supoort member receiving said guide elements in spaced lateral relationship.

10. A reel as set forth in claim 1 wherein said support member is stationary.

11. A reel as set forth in claim 1 wherein said support member is rotatable.

12. A storage device for filamentary material comprising a fixed housing;

a drive member rotatably mounted in said housing for rotation about a rotational axis;

a fixed support member disposed on said rotational axis;

a cylindrical winding drum having a central axis;

a plurality of elements mounted peripherally on said drum and being adjustable radially of said drum central axis to guide a winding of filamentary material thereon for delivery axially therefrom; and means securing said drum to said support member in a tranversely adjustable manner relative to said rotational axis.

13. A storage device as set forth in claim 10 further comprising an aperture in a periphery of said winding drum, a plurality of guide elements extending through said aperture to drive individual windings of filamentary material along said peripherally mounted elements, a first shaft mounted in said winding drum for driving said guide elements and being offset from said rotational axis, and a drive shaft extending from said drive member through said fixed support on said rotational axis into driving engagement with said first shaft.

14. A storage device as set forth in claim 13 further comprising a fork-shaped guide bow member adjustably securing said winding drum to said fixed housing.

15. A storage device as set forth in claim 12 which further comprises a guide tube in said drive member for feeding filamentary material onto said peripherally disposed elements on said drum.

16. A storage device as set forth in claim 12 wherein said means includes a plurality of screws engaging on end face of said drum in offset relation to each other around said central axis and threaded into said support member.

17. A storage device as set forth in claim 16 wherein said support member has a plurality of guide slots for guiding said screws therein.

18. A storage device as set forth in claim 17 wherein each slot is arcuate and concentric of said pivot axis.

* * * * *